US011520281B2

(12) United States Patent
Takahashi

(10) Patent No.: US 11,520,281 B2
(45) Date of Patent: Dec. 6, 2022

(54) IMAGE FORMING APPARATUS HAVING A MOUNTING SURFACE OF AN ELECTRONIC CIRCUIT SUBSTRATE THAT EXTENDS IN A DIRECTION CROSSING AN OUTER SURFACE OF A FRAME FOR EFFICIENT USE OF SPACE

(71) Applicant: CANON KABUSHIKI KAISHA, Tokyo (JP)

(72) Inventor: Ryosuke Takahashi, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/359,317

(22) Filed: Jun. 25, 2021

(65) Prior Publication Data

US 2021/0405578 A1 Dec. 30, 2021

(30) Foreign Application Priority Data

Jun. 30, 2020 (JP) ..... JP2020-113357

(51) Int. Cl.
*G03G 21/16* (2006.01)
*G03G 21/20* (2006.01)
*G03G 15/00* (2006.01)

(52) U.S. Cl.
CPC ..... *G03G 21/1652* (2013.01); *G03G 15/80* (2013.01); *G03G 21/1619* (2013.01); *G03G 21/206* (2013.01)

(58) Field of Classification Search
CPC ..... G03G 21/1652; G03G 15/80; G03G 21/1619; G03G 21/206
See application file for complete search history.

(56) References Cited

U.S. PATENT DOCUMENTS 5,001,516 A * 3/1991 Maruyama ..... G03G 21/1652 361/730
5,414,492 A * 5/1995 Kubota ..... G03G 15/80 399/130
2013/0259511 A1* 10/2013 Koyama ..... G03G 21/206 399/92
2017/0139370 A1* 5/2017 Matsuno ..... G03G 21/1619
2019/0101848 A1* 4/2019 Hijikata ..... G03G 21/1647

FOREIGN PATENT DOCUMENTS

JP 2016122109 A 7/2016
JP 2018084734 A 5/2018
JP 2019174551 A 10/2019

* cited by examiner

*Primary Examiner* — Sandra Brase

(74) *Attorney, Agent, or Firm* — Canon U.S.A., Inc. IP Division

(57) ABSTRACT

An image forming apparatus includes an image forming unit configured to form an image on a recording medium, a first frame and a second frame configured to support the image forming unit, the first frame and the second frame being provided to sandwich the image forming unit, an outer casing member extending along a surface of the first frame configured to cover the first frame, and an electronic circuit substrate that is provided on a side opposite to the image forming unit via the surface of the first frame, and is provided between the first frame and the outer casing member, wherein the electronic circuit substrate extends in a direction crossing a surface of the outer casing member.

13 Claims, 11 Drawing Sheets

IMAGE FORMING APPARATUS HAVING A MOUNTING SURFACE OF AN ELECTRONIC CIRCUIT SUBSTRATE THAT EXTENDS IN A DIRECTION CROSSING AN OUTER SURFACE OF A FRAME FOR EFFICIENT USE OF SPACE

BACKGROUND OF THE INVENTION

Field of the Invention

The present disclosure relates to an electrophotographic image forming apparatus that forms and fixes an image on a recording medium.

Description of the Related Art

Image forming apparatuses such as laser printers and copy machines are structured to include an image forming unit that forms an image and transfers the image onto a recording medium, a supply unit that supplies the recording medium placed thereon to the image forming unit, and a fixing unit that fixes the image to the recording medium. The image forming unit, the supply unit, and the fixing unit each have a drive unit including a drive source, a drive transmission member, and a drive member. A power substrate and a control substrate are provided to operate these drive units. Conventionally, electronic circuit substrates such as the power supply substrate and the control substrate have been frequently arranged between a frame, which supports the image forming unit, the supply unit, and the fixing unit and an outer casing, which covers an outer side of the apparatus. For example, there has been proposed a structure of an image forming apparatus in which a power supply substrate is arranged in parallel to a conveyance path without upsizing the apparatus (Japanese Patent Application Laid-Open No. 2018-84734).

However, in a case where the electronic circuit substrates are arranged in parallel to the conveyance path, this may decrease the workability of jam clearance when the conveyance path is opened. In addition, outer casing members are arranged on the outside of each of a pair of side frames, and the electronic circuit substrate is arranged between the side frame and the outer casing member. A drive unit is attached to one of the pair of side frames to drive the image forming unit on the same surface as the electronic circuit substrate. The drive unit is large in size due to its complex mechanism, especially in a color printing machine, which provides no sufficient space for arranging the electronic circuit substrate. Thus, the electronic circuit substrate is arranged beside the drive unit so that the space underneath the drive unit is not used sufficiently.

SUMMARY OF THE INVENTION

An image forming apparatus includes an image forming unit configured to form an image on a recording medium, a first frame and a second frame configured to support the image forming unit, the first frame and the second frame being provided to sandwich the image forming unit, an outer casing member extending along a surface of the first frame configured to cover the first frame, and an electronic circuit substrate that is provided on a side opposite to the image forming unit via the surface of the first frame, and is provided between the first frame and the outer casing member, wherein the electronic circuit substrate extends in a direction crossing a surface of the outer casing member.

Further features of the present disclosure will become apparent from the following description of exemplary embodiments with reference to the attached drawings.

DESCRIPTION OF THE EMBODIMENTS

Hereinafter, a first exemplary embodiment in the present disclosure will be described.

<Image Forming Apparatus>

Figure 1:
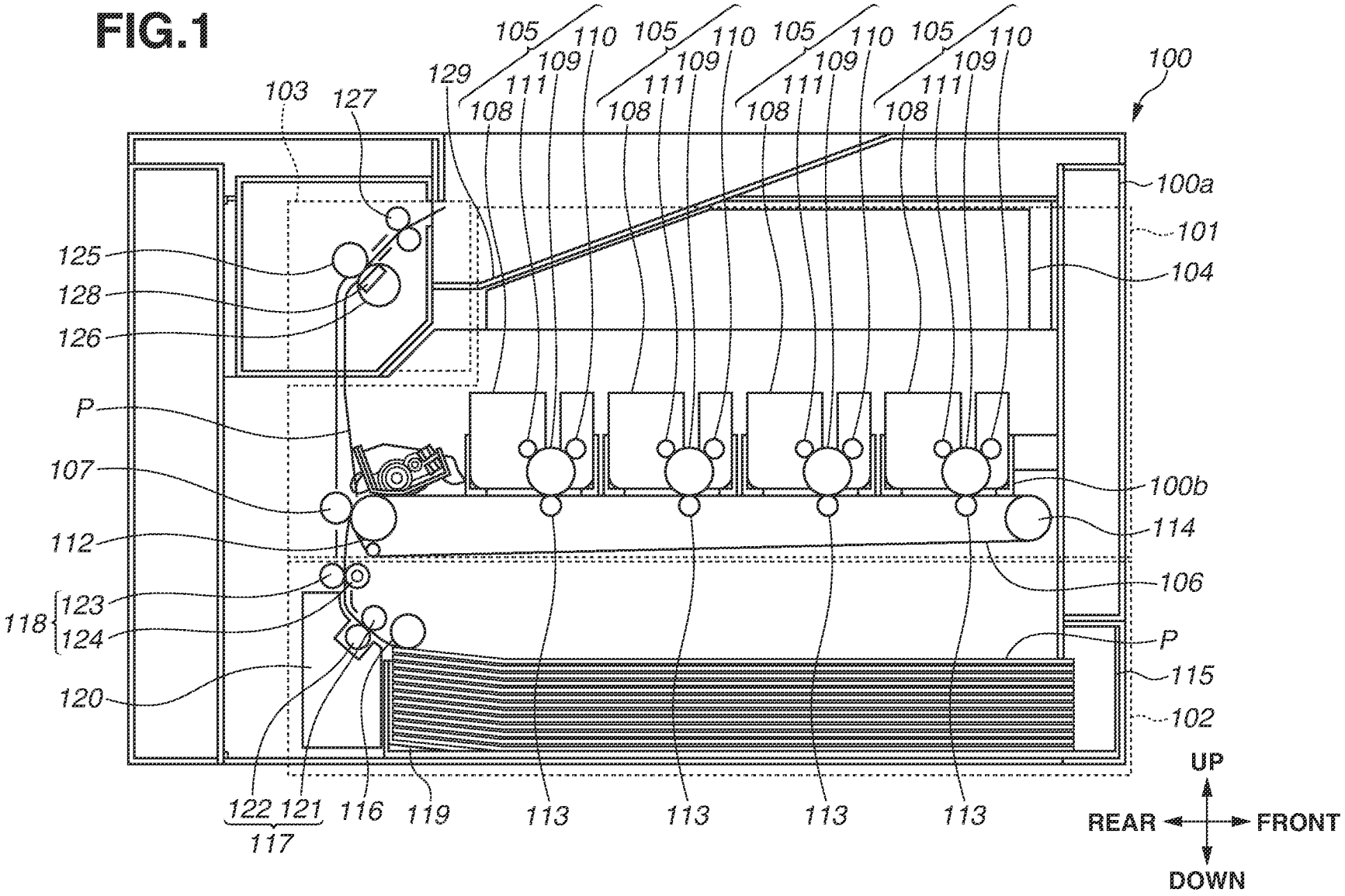
FIG. 1 is a cross-sectional view of an image forming apparatus according to a first exemplary embodiment, which describes an image forming process performed by the image forming apparatus.

FIG. 1 is a schematic diagram describing a color laser printer as an example of an image forming apparatus 100. The image forming apparatus 100 is configured such that a plurality of cartridges 105 can be replaced by turning and opening a cartridge door 100*a* and then pulling out a cartridge support unit 100*b*, which supports the plurality of cartridges 105, from the image forming apparatus 100. In the following description, a surface of the image forming apparatus 100 with the cartridge door 100*a* will be designated as a front surface, and a surface opposing to the front surface as a rear surface. A direction in which the front surface and the rear surface oppose to each other will be designated as a front-rear direction. As the image forming apparatus 100 is viewed from a direction opposing to the front surface, a surface on the right side will be designated as a right surface, and a surface on the left side as a left surface. A direction vertical to a horizontal plane defined by the front-rear direction and a right-left direction will be designated as a perpendicular (up-down) direction.

The image forming apparatus 100 is provided with an image forming unit 101, a recording medium supply unit 102, and a fixing unit 103. The image forming unit 101 includes a laser scanner 104, the cartridges 105, an intermediate transfer belt 106, and a secondary transfer roller 107. The laser scanner 104 is configured to irradiate the cartridges 105 with laser light.

The cartridges 105 each include a toner container 108 that contains toner, a photosensitive drum 109 that is irradiated with laser light from the laser scanner 104, a charging roller 110 that electrically charges the photosensitive drum 109, and a development roller 111 that allows the toner to be adhered to the photosensitive drum 109. The cartridges 105 contain toner of yellow, magenta, cyan, and black, respectively. The four cartridges 105 are perpendicularly arranged below the laser scanner 104.

The intermediate transfer belt 106 is perpendicularly arranged under the four cartridges 105. The intermediate transfer belt 106 is an endless belt. The intermediate transfer belt 106 is supported by a belt driving roller 112, primary transfer rollers 113, and a tension roller 114 provided inside the intermediate transfer belt 106. The intermediate transfer belt 106 is allowed to rotate under a tensile force given by the tension roller 114 and a driving force transferred from the belt driving roller 112. The four primary transfer rollers 113 are in contact with the photosensitive drums 109 of the four cartridges 105 with the intermediate transfer belt 106 therebetween under respective predetermined pressures. The secondary transfer roller 107 is opposed to the belt driving roller 112 with the intermediate transfer belt 106 therebetween and is contact with the intermediate transfer belt 106 under a predetermined pressure.

The recording medium supply unit 102 includes a storage tray 115, a supply roller 116, a separation unit 117, and a conveyance unit 118. The storage tray 115 is a storage unit where recording media P can be stacked, and is detachable from the image forming apparatus 100 by being pulled out forward. The storage tray 115 has a lift plate 119 that can be moved up and down according to the number of the stacked recording media P. The supply roller 116 is opposed to the storage tray 115 with the stacked recording media P therebetween. The separation unit 117 is provided on a transfer guide 120 downstream of the supply roller 116 and includes a transfer roller 121 and a separation roller 122. The transfer roller 121 and the separation roller 122 are each provided with a rubber member on its surface. The separation roller 122 contains a torque limiter to generate a predetermined load torque. The separation roller 122 is in contact with the transfer roller 121 under a predetermined pressure. When the transfer roller 121 is driven, the separation roller 122 follows the transfer roller 121 while generating the predetermined load torque. The conveyance unit 118 is provided downstream of the separation unit 117 and upstream of a nip portion of the secondary transfer roller 107, and includes a registration pair 123 and a shutter member 124. The shutter member 124 is rotatable under a predetermined load and is arranged upstream of the nip portion of the registration pair 123. The fixing unit 103 includes a fixing roller 125, a pressure-heat member 126, and a discharge roller pair 127. The fixing roller 125 is arranged downstream of the secondary transfer roller 107 and is in contact with the pressure-heat member 126 under a predetermined pressure. The pressure-heat member 126 internally has a heat-generation member 128. The discharge roller pair 127 is provided downstream of the fixing roller 125.

<Image Forming Operation>

Upon input of a print signal, the image forming apparatus 100 starts a printing operation. The four photosensitive drums 109 start rotating and the laser scanner 104 irradiates the surfaces of the four photosensitive drums 109 with laser light according to image information to be printed. Each of the photosensitive drums 109 has a surface electrically charged by the charging roller 110 so that an electrostatic latent image is formed on the surface based on the irradiated laser light. The electrostatic latent image on the surface of the respective photosensitive drums 109 is supplied with toner and developed into a toner image by the development roller 111. The toner image on the surface of the respective photosensitive drums 109 is transferred onto the intermediate transfer belt 106 under a voltage applied to the primary transfer rollers 113. While the toner image is transferred from the respective cartridges 105 onto the intermediate transfer belt 106, the intermediate transfer belt 106 is driven by the belt driving roller 112 to convey the toner image to the nip portion of the secondary transfer roller 107. Along with the above-described operation, in the recording medium supply unit 102, the supply roller 116 conveys the recording medium P stacked on the storage tray 115 to the separation unit 117. In a case where a plurality of recording media P is conveyed to the separation unit 117, only one of the recording media P is separated by the nip portion with the load torque of the separation roller 122, and conveyed to the conveyance unit 118. In the conveyance unit 118, a leading end of the recording medium P comes into contact with the shutter member 124. Since the shutter member 124 is provided with a predetermined rotation load, the recording medium P pushes the shutter member 124 away and enters into the nip portion of the registration pair 123 while forming a loop under the conveyance force from the separation unit 117. If the recording medium P is skewed due to the formation of the loop, the leading end of the recording medium P obliquely contacts the shutter member 124, but the recording medium P is straightened along the shutter member 124 and corrected to have no skew by being held using the registration pair 123. After having passed through the registration pair 123, the recording medium P is conveyed to the nip portion formed between the secondary transfer roller 107 and the belt driving roller 112 at a controlled conveyance speed, and the toner images are transferred by the intermediate transfer belt 106 onto the recording medium P. The recording medium P having the transferred toner images is conveyed to a contact portion between the fixing roller 125 and the pressure-heat member 126. The toner on the recording medium P is melted and fixed by pressurizing and heating a surface thereof. Then, the recording medium P is discharged outside the apparatus by the discharge roller pair 127 and is stacked in succession on a discharge tray 129 at the top of the apparatus.

<Outer Casing Member>

Figure 2:
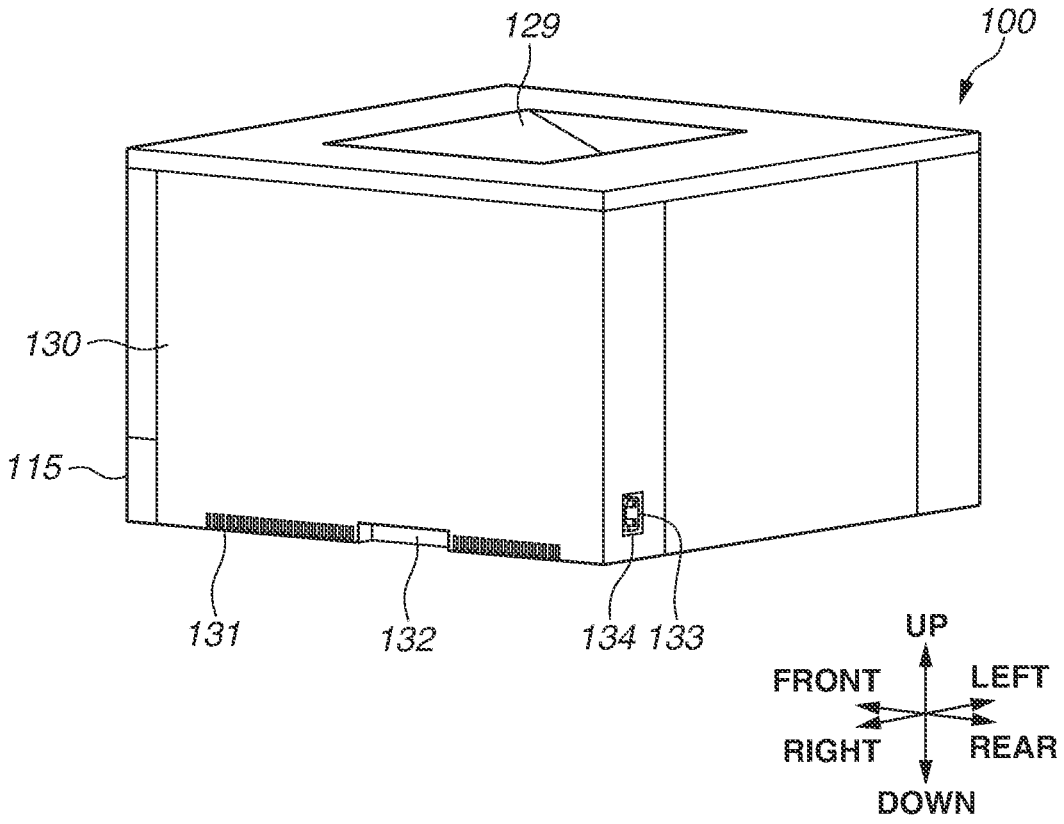
FIG. 2 is a perspective view of the image forming apparatus according to the first exemplary embodiment.

FIG. 2 is a perspective view of the image forming apparatus 100. An outer casing member 130 is arranged on a side surface (right surface) of the image forming apparatus 100. The outer casing member 130 includes a handhold 132, a louver 131, and an inlet opening portion 133. The handhold 132 (a recessed portion) is formed on the outer casing member 130 near the center along the front-rear direction of the image forming apparatus 100 such that a portion of the handhold 132 connected to a bottom surface of the image forming apparatus 100 is recessed toward inside of the image forming apparatus 100. Although not illustrated in the drawing, a similar handhold is arranged on the opposite side of the outer casing member 130 of the image forming apparatus 100, so that a user can lift the image forming apparatus 100 with his/her fingers hooked into the handholds 132 from the both sides of the image forming apparatus 100. The handholds 132 are positioned taking into account the center of gravity of the image forming apparatus 100, so that, when being lifted, the posture of the apparatus becomes stabled. A plurality of louvers 131 is provided on the both sides of the handhold 132 along the front-rear direction of the image forming apparatus 100 and constitute openings for taking air into the apparatus. The inlet opening portion 133 is capable of insertion of a power cord and is provided on a rear surface adjacent to and orthogonal to the side surface of the outer casing member 130 on which the handhold 132 and the louvers 131 are provided. The inlet opening portion 133 is formed such that an inlet 134 provided in a power supply unit 138 described below is exposed from inside. The image forming apparatus 100 is supplied with electric power by connecting a power cord, which is connected to a commercial power source, into the inlet 134.

Figure 3:
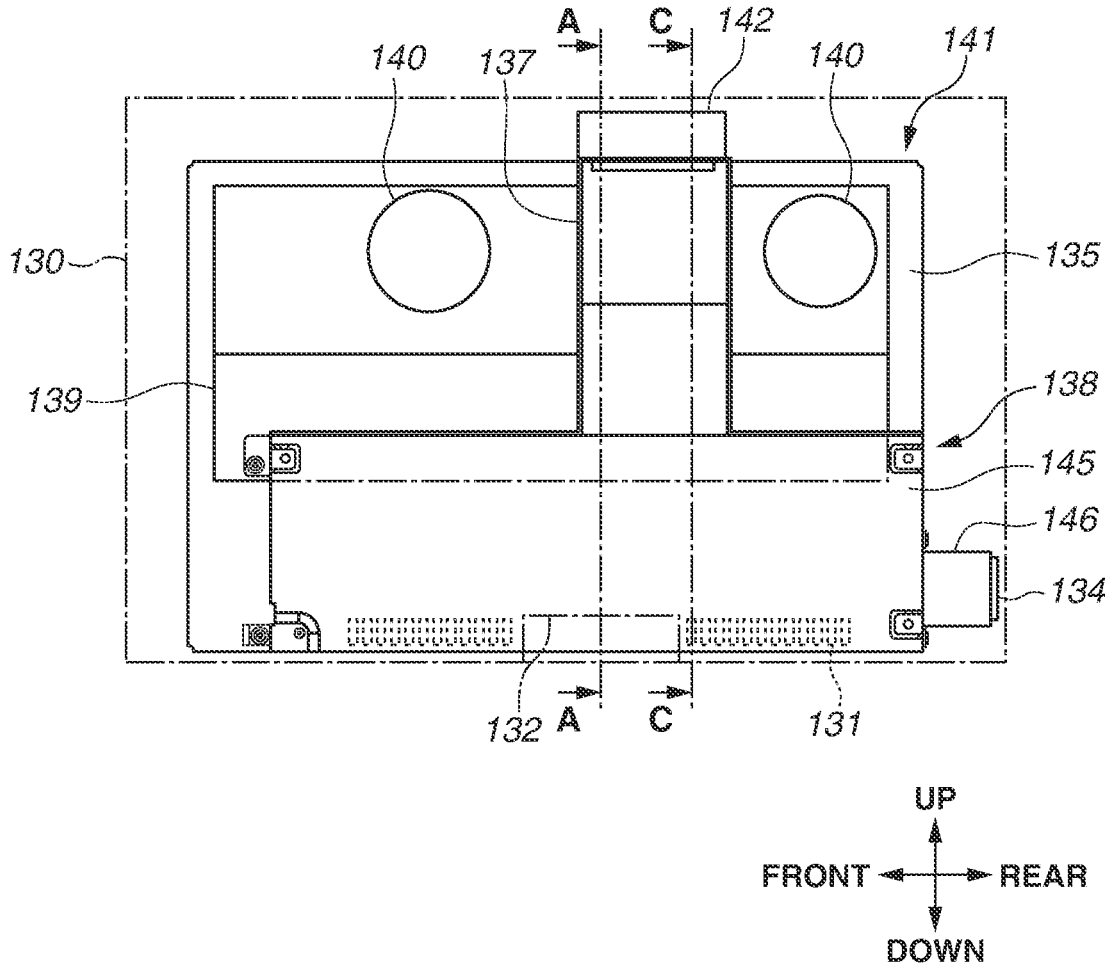
FIG. 3 is a side view of the inside of outer casing member according to the first exemplary embodiment.
Figure 4:
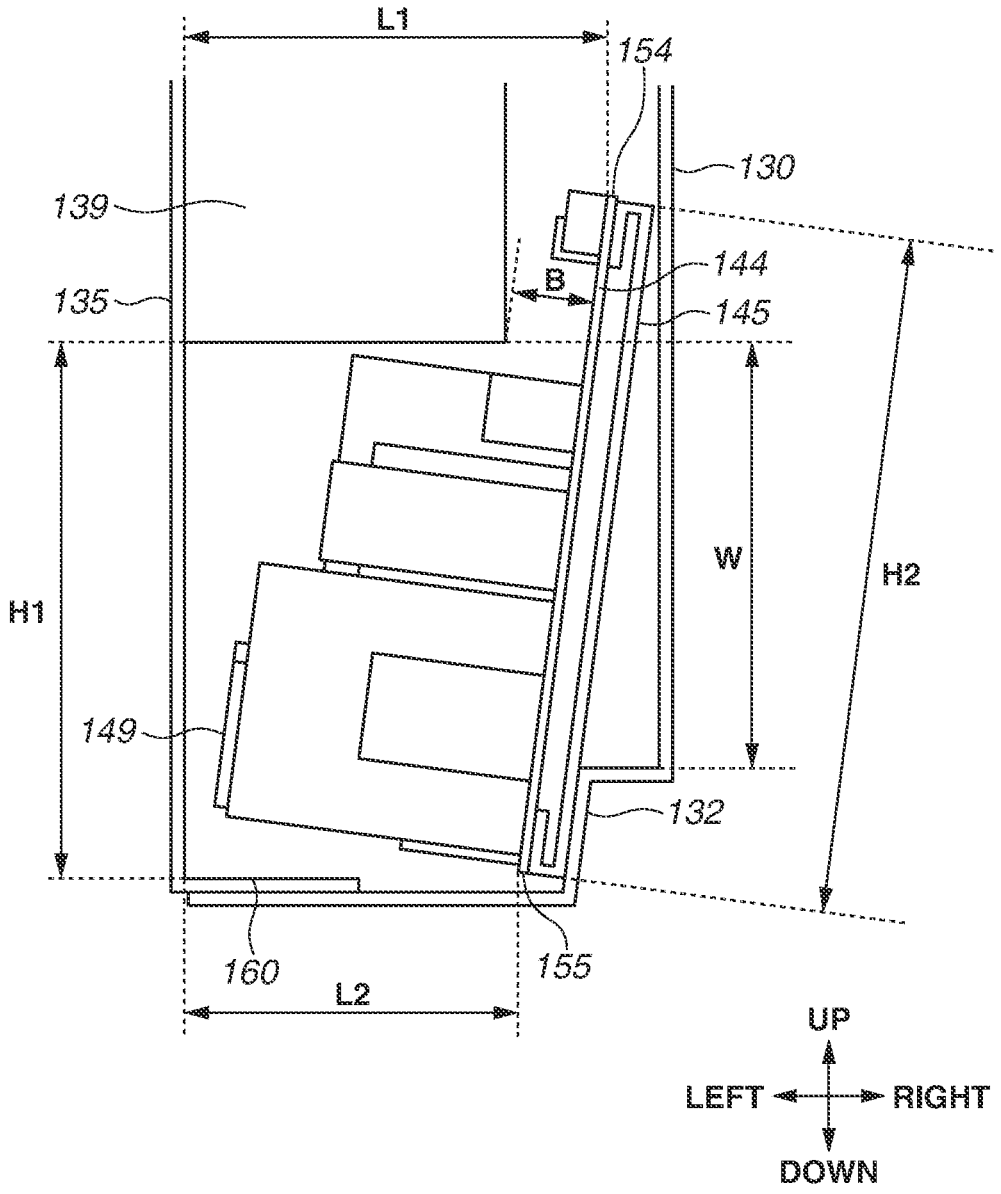
FIG. 4 is a cross-sectional view of a power supply unit according to the first exemplary embodiment, which describes an arrangement of the power supply unit.

FIG. 3 is a side view of inside of the outer casing member 130 where the outer casing member 130, the louvers 131, and the handhold 132 are indicated by dashed-dotted lines. FIG. 4 is a cross-sectional view of the power supply unit 138 taken by a section line A-A in FIG. 3.

The outer casing member 130 is arranged to be opposed to a side frame 135 to cover the side frame 135. An image forming driving unit 141 is attached to the side frame 135 between the outer casing member 130 and the side frame 135. The side frame 135 is a plate-like frame made of metal or resin forming a part of a housing of the image forming apparatus 100, and supports a right end of the image forming unit 101 including the cartridges 105 in a direction of a rotational axis of the photosensitive drum 109. Another side frame (not illustrated) is provided at a position opposed to the side frame 135 via the image forming unit 101, and supports a left end of the image forming unit 101 in the direction of the rotational axis. The side frame 135 and the another side frame (not illustrated) are provided to sandwich the image forming unit 101. The image forming driving unit 141 for driving the image forming unit 101 and the power supply unit 138 are mounted on the side frame 135.

The image forming driving unit 141 includes an image forming driving frame 139, a motor 140 as a driving source, and a drive transmission member, not illustrated, formed by a gear and the like inside the image forming driving frame 139. The image forming driving unit 141 can transmit the driving force of the motor 140 to the image forming unit 101. The image forming driving frame 139 is provided with an air duct 137 as described below, and a fan 142 is placed at the top of the air duct 137. The power supply unit 138 includes a power supply substrate 144 as an electronic circuit substrate and a substrate holding member 145.

<Configuration of Power Supply Unit>

Figure 5:
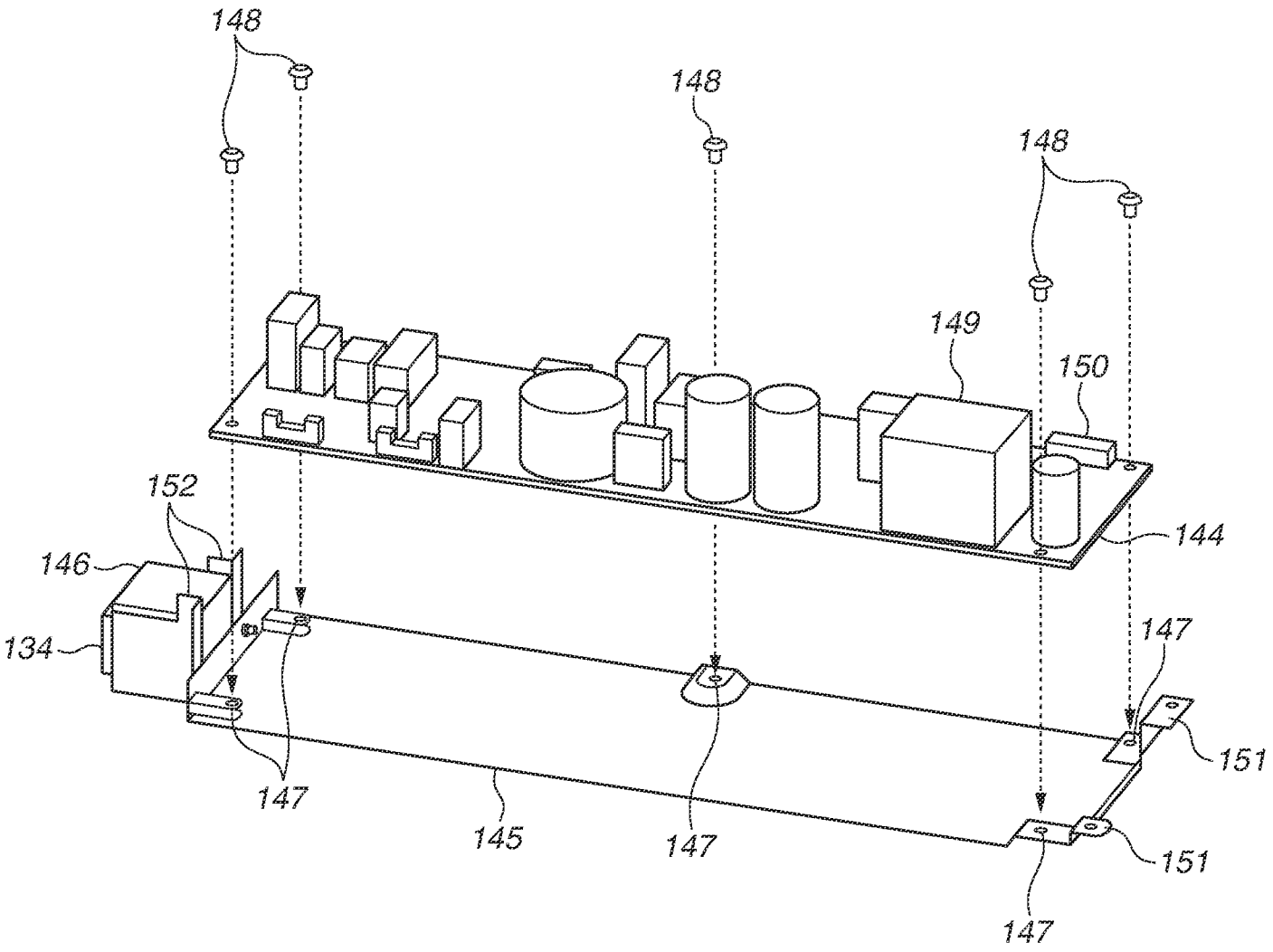
FIG. 5 is an exploded perspective view of a configuration of the power supply unit according to the first exemplary embodiment.

A configuration of the power supply unit 138 will be described. FIG. 5 is an exploded perspective view of the configuration of the power supply unit 138. The power supply unit 138 includes the power supply substrate 144, the substrate holding member 145, the inlet 134, and an inlet holding member 146. The substrate holding member 145 is formed of a metal plate and has a plurality of substrate holding surfaces 147 for attaching the power supply substrate 144. The power supply substrate 144 is fastened via screws 148 to the substrate holding member 145 at a plurality of places. Some of the places act as earths. The substrate holding member 145 suppresses external magnetic influence and covers almost an entire surface of the power supply substrate 144 to prevent occurrence of noise in the power supply substrate 144. The substrate holding member 145 has a bend portion at one end (a rear side of the image forming apparatus 100) orthogonal to the plurality of substrate holding surfaces 147, and the inlet holding member 146 is attached to the bend portion. The inlet holding member 146 can hold the inlet 134. The inlet 134 is electrically connected to the power supply substrate 144 and has a role of supplying electric power to the inside of the image forming apparatus 100 when a power cord connected to a commercial power source is plugged into the inlet 134. The power supply substrate 144 has various electronic circuit elements 149 arranged to convert an externally input alternating current into a direct current or reduce the voltage to a predetermined voltage value. The electronic circuit elements 149 include electronic circuit elements 149 accompanied by heat generation and a connector 150 for connecting a motor substrate. The electronic circuit elements 149 accompanied by heat generation need cooling by an air flow. As attachment surfaces for attaching the power supply unit 138 to the image forming apparatus 100, first attachment surfaces 151 are provided on the substrate holding member 145, and second attachment surfaces 152 are provided on the inlet holding member 146. The first attachment surfaces 151 are provided at the other end (a front side of the image forming apparatus 100) opposite to the one end at which the inlet holding member 146 is provided.

<Arrangement of Power Supply Unit>

Figure 6:
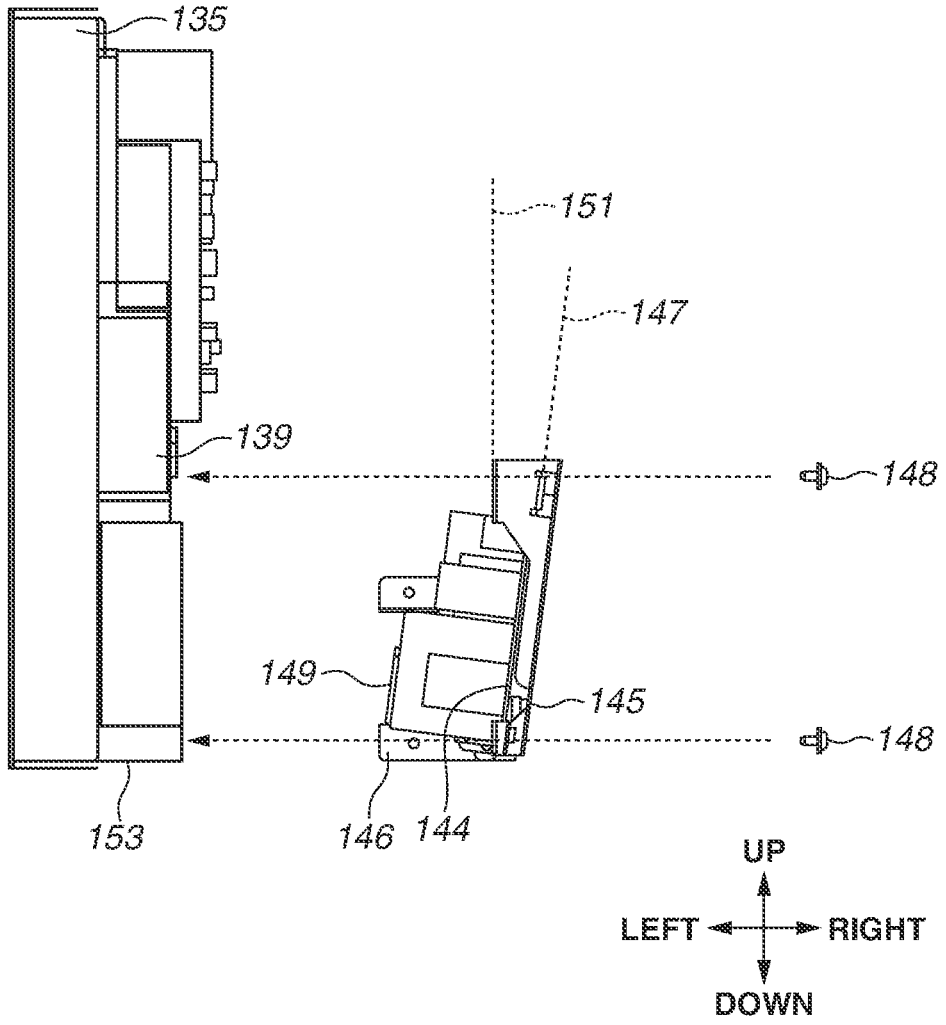
FIG. 6 is a side view of the power supply unit according to the first exemplary embodiment, which describes attachment of the power supply unit.
Figure 7:
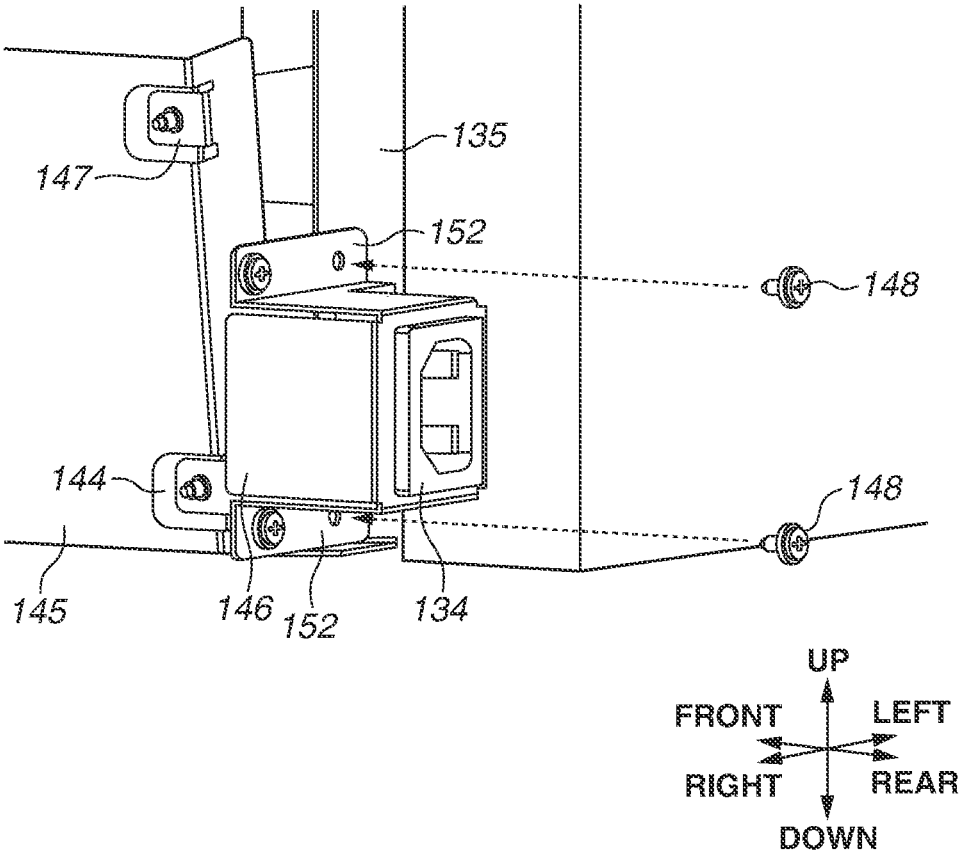
FIG. 7 is a perspective view of the power supply unit according to the first exemplary embodiment, which describes attachment of the power supply unit.

FIG. 6 is a side view of one of the first attachment surfaces 151 at the time of attachment of the power supply unit 138 to the apparatus, and FIG. 7 is a perspective view of the second attachment surfaces 152 at the time of attachment of the power supply unit 138 to the apparatus. The substrate holding member 145 includes the substrate holding surfaces 147 for holding the power supply substrate 144 and the first attachment surfaces 151 for attaching the power supply unit 138 to a power source attachment member 153 provided on the image forming driving frame 139 and the side frame 135. When the power supply substrate 144 is fastened by the screws 148, the substrate holding surfaces 147 are capable of holding the power supply substrate 144. The first attachment surfaces 151 are fastened by the screws 148 to the power source attachment member 153, and the power supply unit 138 is fixed to the side frame 135 via the image forming driving frame 139 or is fixed directly to the side frame 135. In this way, the power supply unit 138 is attached to the side frame 135.

In the present exemplary embodiment, the substrate holding member 145 is provided with the substrate holding surfaces 147 tilted at a predetermined angle with respect to the first attachment surfaces 151. That is, the substrate holding surfaces 147 are in a relationship of crossing with the first attachment surfaces 151. Accordingly, when the power supply unit 138 is attached to the image forming apparatus 100 such that the first attachment surfaces 151 extend in the perpendicular direction, the power supply substrate 144 can be held in a tilted position with respect to the side frame 135 extending in the perpendicular direction.

In other words, even if the handhold 132 is provided in the outer casing member 130 such that the portion of the handhold 132 connected to the bottom surface of the image forming apparatus 100 is recessed toward the inside of the image forming apparatus 100, it is possible to prevent interference between the power supply substrate 144 and the handhold 132. This allows a lower end of the power supply substrate 144 to be arranged between the image forming driving frame 139 and the side frame 135, and below the image forming driving frame 139 along the perpendicular direction. Thus, when viewed from a direction from the outer casing member 130 to the side frame 135 (when viewed from a direction vertical to the surface of the outer casing member 130), a lower end portion 155 appears to overlap the handhold 132. That is, the lower end portion 155 of the power supply substrate 144 is positioned between the side frame 135 and the handhold 132 in the right-left direction. In this manner, the power supply substrate 144 is tilted such that a distance L1 between an upper end portion 154 and the side frame 135 is longer than a distance L2 between the lower end portion 155 and the side frame 135 (L1>L2). The power supply substrate 144 extends in the direction crossing the surface of the outer casing member 130, is tilted such that a lower side of the substrate holding member 145 and the handhold 132 are close to each other, and an upper side of the substrate holding member 145 and the outer casing member 130 are close to each other.

A distance H1 from a bottom surface 160 of the image forming apparatus 100 to the image forming driving frame 139 along the perpendicular direction is shorter than a length H2 of the power supply substrate 144 at a cross-sectional surface extending in the perpendicular direction (H1<H2). Thus, the upper end portion 154 of the power supply substrate 144 is positioned between the image forming driving frame 139 and the outer casing member 130 such that, when viewed from the direction from the outer casing member 130 toward the side frame 135, the upper end portion 154 appears to overlap the image forming driving frame 139. In the perpendicular direction, in a case where the power supply substrate 144 is perpendicularly arranged above the handhold 132 and below the image forming driving frame 139, a height W from an upper end of the handhold 132 to a lower end of the image forming driving frame 139 needs to be equal to or greater than the length H2 of the power supply substrate 144. As a result, it is difficult to downsize the image forming apparatus 100. In the present exemplary embodiment, however, the height W from the upper end of the handhold 132 to the lower end of the image forming driving frame 139 can be made smaller than the length H2 of the power supply substrate 144 in the perpendicular direction, thereby allowing downsizing of the image forming apparatus 100.

In the configuration of the present exemplary embodiment, since the power supply substrate 144 is tilted with respect to the perpendicular direction, the electronic circuit elements 149 in the vicinity of the image forming driving frame 139 further come close to the image forming driving frame 139. This may cause the electronic circuit elements 149 of large heights from the surface of the power supply substrate 144 to bump against the image forming driving frame 139. Thus, the electronic circuit elements 149 of large heights from the substrate surface are arranged according to a distance between the power supply substrate 144 and the image forming driving frame 139, and a distance between the power supply substrate 144 and the side frame 135. That is, the electronic circuit elements 149 of large heights from the substrate surface are perpendicularly arranged below the image forming driving frame 139 and near the image forming driving frame 139. In other words, the electronic circuit elements 149 are arranged such that the heights of the electronic circuit elements 149 from the substrate surface become larger from the upper end portion 154 of the power supply substrate 144 toward the lower end portion 155 of the power supply substrate 144. In this way, even if the power supply substrate 144 is tilted, the electronic circuit elements 149 of large heights from the substrate surface can be arranged. In addition, when the power supply substrate 144 is tilted, the own weights of the electronic circuit elements 149 act with respect to a holding direction of the substrate holding member 145, so that it is possible to reduce the influence of vibration and the like and hold the power supply substrate 144 in a stable manner.

Examples of the electronic circuit elements 149 of large heights from the substrate surface include a low-voltage power supply transformer, a heat sink, and an electrolytic capacitor. The electrolytic capacitor has a role of smoothing out the alternating-current voltage supplied via the inlet 134 from an external power source. The low-voltage power supply transformer has a role of decreasing the input voltage that has been smoothed out by the electrolytic capacitor and converted again into an alternating-current voltage by a switching element. The heat sink is provided to dissipate heat from the power supply substrate 144.

As described above, the substrate holding member 145 has the bend portion orthogonal to the substrate holding surfaces 147 at the end portion of the substrate holding member 145, and the inlet holding member 146 is attached to the bend portion. The inlet holding member 146 has the second attachment surfaces 152 where the inlet holding member 146 is attached to the bend portion of the substrate holding member 145. As illustrated in FIG. 7, the substrate holding member 145 can be attached to the side frame 135 by fastening the second attachment surfaces 152 of the inlet holding member 146 via the screws 148 to the side frame 135 from the rear side of the image forming apparatus 100. The first attachment surfaces 151 and the second attachment surfaces 152 are each grounded by being fastened at least at one place by the screws 148 to at least one of the side frame 135 and the outer casing member 130, both of which are each made of a metal plate.

<Air Flow Configuration>

Figure 8:
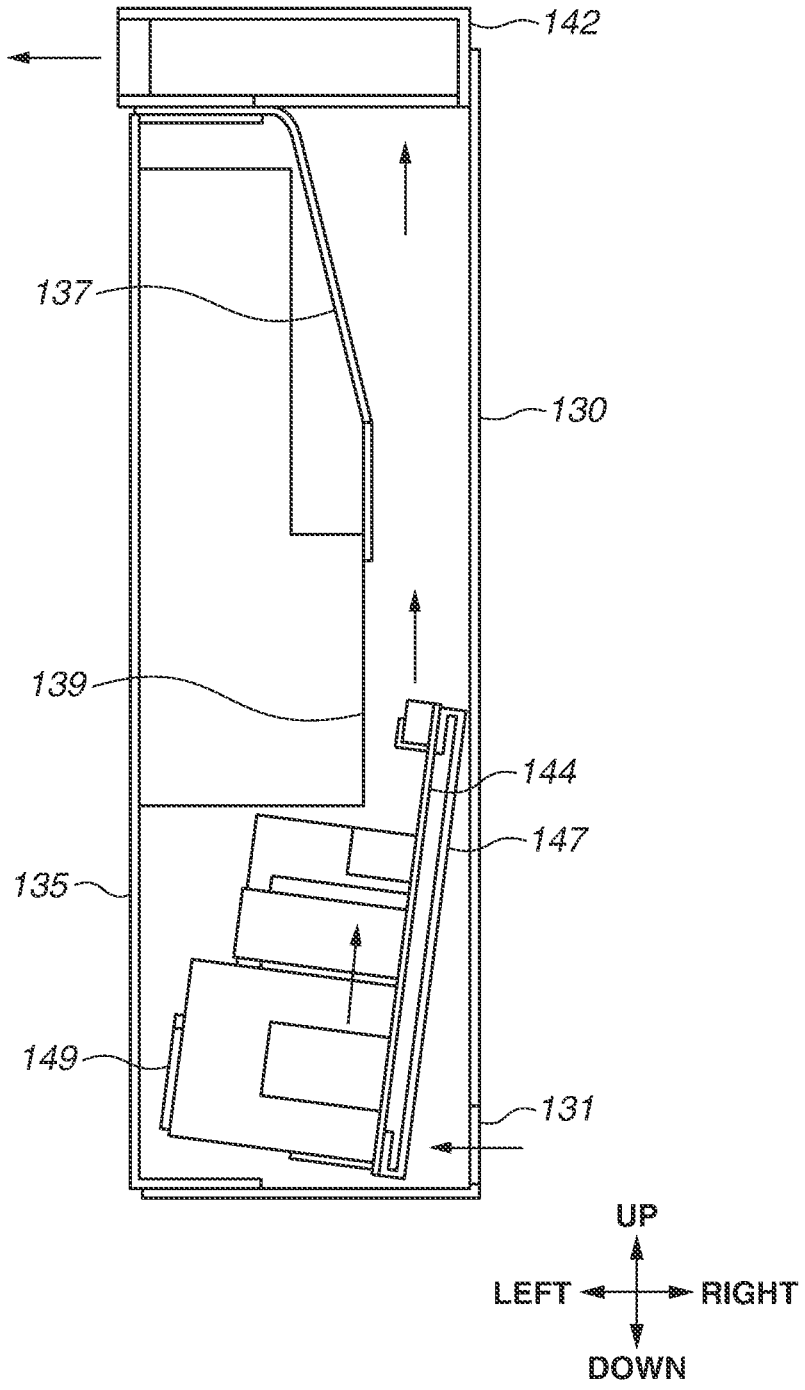
FIG. 8 is a cross-sectional view describing an air-flow configuration according to the first exemplary embodiment.

An air flow configuration will be described. FIG. 8 illustrates an air path forming an air flow, which is a cross-sectional view of FIG. 3 taken along a section line C-C. An air flow is provided to cool the electronic circuit elements 149 accompanied by heat generation on the power supply substrate 144. The outer casing member 130 has the louvers 131 on the both sides of the handhold 132 in the front-rear direction of the image forming apparatus 100 as illustrated in FIG. 2. An air duct 137 is attached to the image forming driving frame 139, and a fan 142 is installed perpendicularly above the air duct 137. Arrows in the drawing each indicate a flow of air. When being activated, the fan 142 starts to suck the air on a side of the power supply substrate 144. Then, the air enters from the louvers 131 on the outer casing member 130 into the apparatus to generate an air flow. The air flows around the substrate holding member 145 and toward a mounting surface of the power supply substrate 144 on which the electronic circuit elements 149 are mounted. The air path is formed between the power supply substrate 144 and the side frame 135 at the position opposing to the mounting surface, and between the power supply substrate 144 and the image forming driving frame 139. Perpendicularly above the power supply substrate 144, the air path to the fan 142 is formed by the image forming driving frame 139, the air duct 137, and the outer casing member 130. The air flows from the lower side to the upper side of the power supply substrate 144 through the plurality of electronic circuit elements 149, while drawing heat from the electronic circuit elements 149 to cool the electronic circuit elements 149. Then, the air flows into the air path formed by the air duct 137 and the outer casing member 130 and is sucked by the fan 142. The air having sucked by the fan 142 passes through the image forming apparatus 100 to cool the fixing unit 103 and the cartridges 105, and then is discharged out of the image forming apparatus 100.

In the present exemplary embodiment, to cool the electronic circuit elements 149 accompanied by heat generation on the power supply substrate 144, the power supply substrate 144 and the image forming driving frame 139 are spaced from each other by a predetermined distance B to form the air path between the power supply substrate 144 and the image forming driving frame 139. The air taken in via the air duct 137 is narrowed in a space between the upper end portion 154 of the power supply substrate 144, i.e., the upper end portion of the substrate holding member 145 and the outer casing member 130. Thus, the air flows around from the end portions of the power supply substrate 144 and the substrate holding member 145 in the front-rear direction of the image forming apparatus 100. As a result, the air flows toward the mounting surface from a surface of the power supply substrate 144 opposite to the mounting surface to cool the electronic circuit elements 149 on the mounting surface, and then is sucked by the fan 142 via the space between the power supply substrate 144 and the image forming driving frame 139.

According to the configuration of the present exemplary embodiment described above, the upper end portion 154 of the power supply substrate 144 overlaps the image forming driving frame 139 as viewed from the direction from the outer casing member 130 toward the side frame 135 (the direction vertical to the surface of the outer casing member 130). In addition, the lower end portion 155 of the power supply substrate 144 overlaps the handhold 132 as viewed from the direction from the outer casing member 130 toward the side frame 135 (the direction vertical to the surface of the outer casing member 130). As a result, by tilting the power supply substrate 144 such that the distance L1 between the upper end portion 154 and the side frame 135 is longer than the distance L2 between the lower end portion 155 and the side frame 135 (L1>L2), it is possible to achieve the efficient use of the space, which leads to downsizing of the apparatus.

Figure 9:
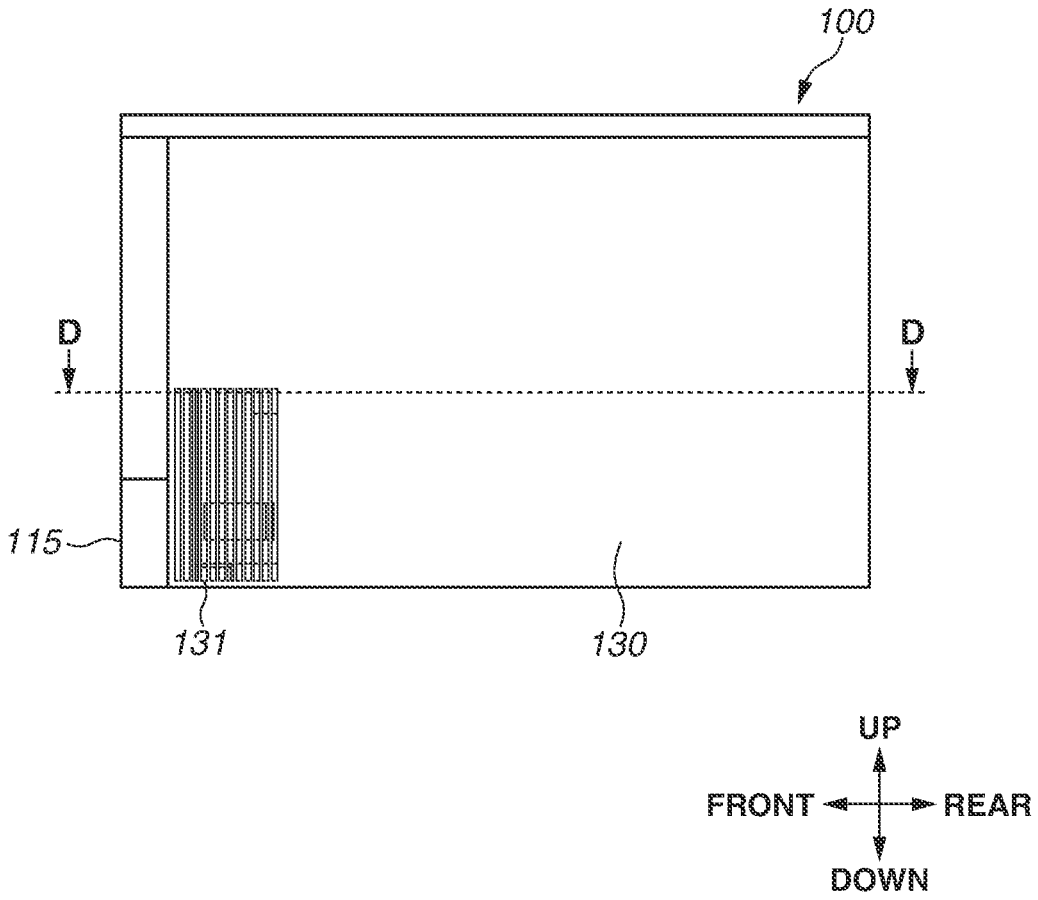
FIG. 9 is a side view of an image forming apparatus according to a second exemplary embodiment.

Hereinafter, a second exemplary embodiment in the present disclosure will be described. Description of components similar to those in the first exemplary embodiment will be omitted. FIG. 9 is a side view of the image forming apparatus 100 in the second exemplary embodiment. In the first exemplary embodiment, the power supply substrate 144 is tilted with respect to the perpendicular direction. The second exemplary embodiment is different from the first exemplary embodiment in that the power supply substrate 144 is tilted with respect to the front-rear direction.

Figure 10:
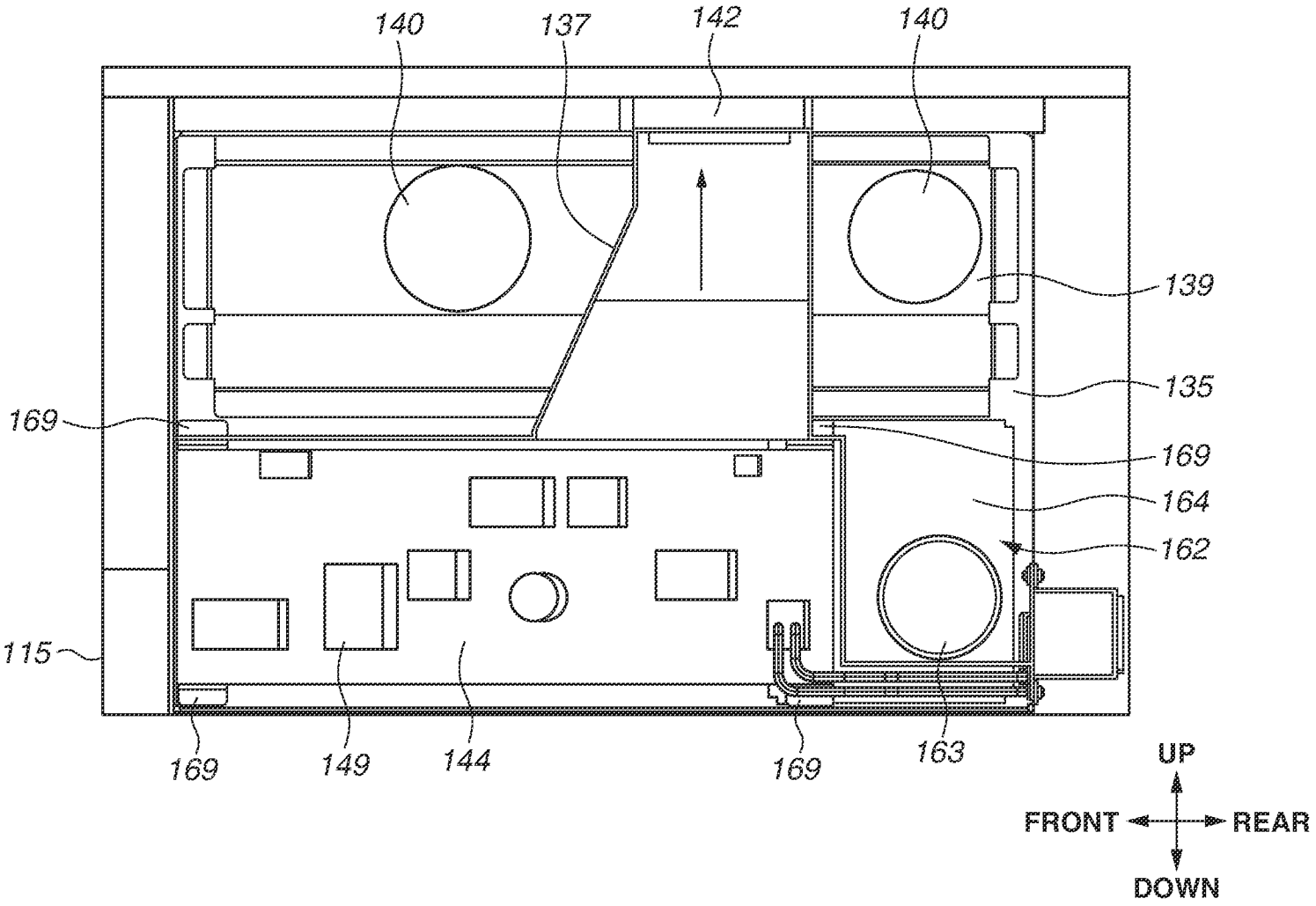
FIG. 10 is a side view of a power supply unit according to the second exemplary embodiment, which describes arrangement of the power supply unit.

In the present exemplary embodiment, the outer casing member 130 arranged on a side surface of the image forming apparatus 100 has the louvers 131 that are openings for sucking air on the front side of the image forming apparatus 100. FIG. 10 is a side view of the apparatus from which the outer casing member 130 is removed. A supply driving unit 162 is attached to the side frame 135. The supply driving unit 162 has a supply motor 163 as a drive source for driving the supply roller 116 and the registration pair 123 on a supply driving frame 164, and further has a drive transmission member such as a gear, not illustrated, inside the supply driving frame 164. The power supply substrate 144 is attached to the side frame 135 and the supply driving frame 164 via substrate attachment members 169 at the four corners thereof.

Figure 11:
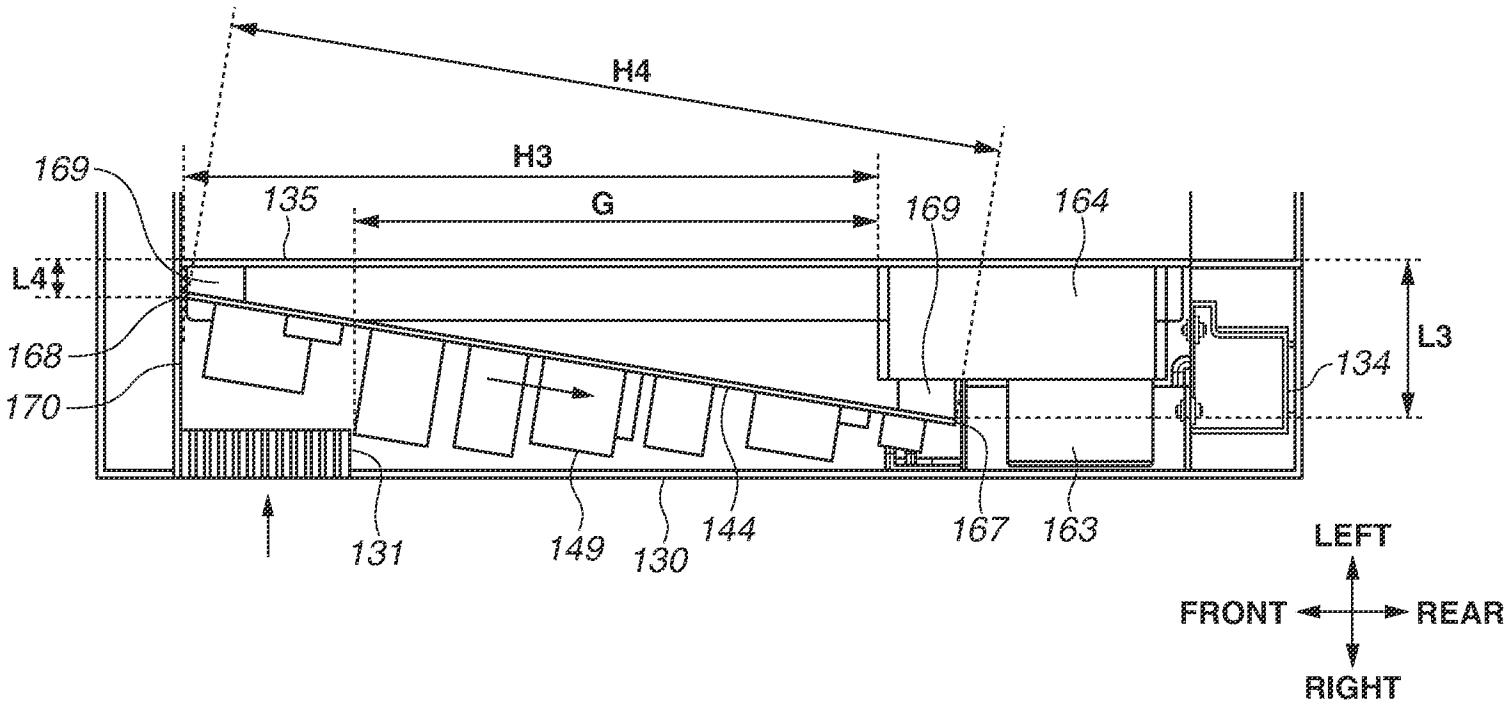
FIG. 11 is a cross-sectional view of a power supply unit according to the second exemplary embodiment, which describes arrangement of the power supply unit.

FIG. 11 illustrates a state in which the power supply substrate 144 is attached to the apparatus, which is a cross-sectional view taken along a section line D-D in FIG. 9. The supply driving frame 164 is attached to the side frame 135, and the louvers 131 (recessed portions) are provided in the outer casing member 130 to protrude toward the inside of the apparatus. The supply driving frame 164 and the louvers 131 are spaced from each other by a predetermined distance G in the front-rear direction of the image forming apparatus 100. A distance H3 from the supply driving frame 164 to a front surface 170 of the outer casing member 130 along the front-rear direction of the image forming apparatus 100 is shorter than a length H4 of the power supply substrate 144 on a cross-sectional surface extending in the front-rear direction of the image forming apparatus 100 (H3<H4). Thus, a rear end portion 167 is positioned between the supply driving frame 164 and the outer casing member 130. Electronic circuit elements 149 are arranged on a surface of the power supply substrate 144 facing the outer casing member 130, so that the electronic circuit elements 149 are cooled by an air flow from the louvers 131. The power supply substrate 144 is tilted to be closer to the side frame 135 such that a distance L3 between the rear end portion 167 and the side frame 135 is longer than a distance L4 between a front end portion 168 and the side frame 135 (L3<L4). The power supply substrate 144 is tilted such that the power supply substrate 144 can extend in a direction crossing the outer casing member 130, the front end portion 168 can come close to the side frame 135, and the power supply substrate 144 and the supply driving frame 164 can be closely disposed. As for the electronic circuit elements 149, the electronic circuit elements 149 of large heights from the substrate surface and the electronic circuit elements 149 of small heights from the substrate surface are arranged according to a distance between the power supply substrate 144 and the louvers 131 and a distance between the power supply substrate 144 and the outer casing member 130. That is, the electronic circuit elements 149 of small heights from the substrate surface are arranged on a side of the supply motor 163, while the electronic circuit elements 149 of large heights from the substrate surface are arranged on the front surface 170 of the outer casing member 130. This allows the electronic circuit elements 149 having a large size to be arranged even if the power supply substrate 144 is tilted.

According to the present exemplary embodiment described above, the rear end portion 167 of the power supply substrate 144 overlaps the supply driving frame 164 as viewed from the direction from the outer casing member 130 toward the side frame 135 (the direction vertical to the surface of the outer casing member 130). In addition, the front end portion 168 of the power supply substrate 144 overlaps the louvers 131 as viewed from the direction from the outer casing member 130 toward the side frame 135 (the direction vertical to the surface of the outer casing member 130). As a result, by tilting the power supply substrate 144 such that the distance L3 between the rear end portion 167 and the side frame 135 is longer than the distance L4 between the front end portion 168 and the side frame 135 (L3>L4), it is possible to achieve the efficient use of the space, which leads to downsizing of the apparatus.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-113357, filed Jun. 30, 2020, which is hereby incorporated by reference herein in its entirety.

What is claimed is:

1. An image forming apparatus comprising:

an image forming unit configured to form an image on a recording medium;

a first frame and a second frame configured to support the image forming unit, the first frame and the second frame being provided to sandwich the image forming unit;

an outer casing member configured to cover the image forming unit, the first frame, and the second frame; and an electronic circuit substrate that is provided on an outer side of the first frame opposite to an inner side of the first frame on which the image forming unit is provided, and is provided between the first frame and the outer casing member, wherein a mounting surface of the electronic circuit substrate on which an electric circuit element is mounted extends in a direction crossing a surface of the first frame which extends in a vertical direction.

2. The image forming apparatus according to claim 1, further comprising a driving unit including a motor, the driving unit being provided on the outer side of the first frame and being provided between the first frame and the outer casing member, wherein, when viewed in a direction perpendicular to the outer surface of the first frame, the driving unit and a first end portion of the electronic circuit substrate overlap, and the electronic circuit substrate is tilted such that the first end portion is distant from the driving unit.

3. The image forming apparatus according to claim 2, wherein the outer casing member has a recessed portion that is recessed inward, and wherein, when viewed in the direction perpendicular to the surface of the first frame, the recessed portion and a second end portion of the electronic circuit substrate opposite to the first end portion of the electronic circuit substrate overlap, and the electronic circuit substrate is tilted such that the second end portion is distant from the recessed portion.

4. The image forming apparatus according to claim 3, wherein a height of the electronic circuit element mounted on the electronic circuit substrate from the mounting surface of the electronic circuit substrate increases from the first end portion to the second end portion.

5. The image forming apparatus according to claim 3, wherein the driving unit and the recessed portion are aligned in the vertical direction.

6. The image forming apparatus according to claim 3, wherein the driving unit and the recessed portion are aligned along a front-rear direction parallel to a horizontal plane and parallel to the surface of the first frame.

7. The image forming apparatus according to claim 3, wherein the recessed portion is a handhold or a louver for taking in air from outside.

8. The image forming apparatus according to claim 1, further comprising a substrate holding member configured to hold the electronic circuit substrate, the substrate holding member including a holding surface that holds the electronic circuit substrate and an attachment surface that crosses the holding surface and extends along the surface of the first frame, wherein the substrate holding member is attached to the first frame via the attachment surface.

9. The image forming apparatus according to claim 8, further comprising an inlet holding member configured to hold an inlet, wherein the substrate holding member and the first frame are coupled together via the inlet holding member.

10. The image forming apparatus according to claim 1, wherein the electronic circuit substrate is a power supply substrate that converts alternating-current power supplied from outside into direct-current power.

11. The image forming apparatus according to claim 1, wherein the image forming unit includes a rotatable image bearing member, and wherein the first frame is configured to support a first end portion of the image bearing member in a direction of a rotational axis of the image bearing member, and the second frame is configured to support a second end portion of the image bearing member in the direction of the rotational axis.

12. The image forming apparatus according to claim 1, wherein, when viewed in a front-rear direction parallel to a horizontal plane and parallel to the outer surface of the first frame, the mounting surface of the electronic circuit substrate extends in a direction crossing the surface of the first frame.

13. The image forming apparatus according to claim 1, wherein, when viewed in the vertical direction, the mounting surface of the electronic circuit substrate extends in a direction crossing the outer surface of the first frame.

* * * * *